US007137934B2

(12) United States Patent
Paramater

(10) Patent No.: US 7,137,934 B2
(45) Date of Patent: Nov. 21, 2006

(54) EXERCISE APPARATUS AND METHOD

(76) Inventor: Kim M. Paramater, 920 Nine Mile Cove S., Hopkins, MN (US) 55343

( * ) Notice: Subject to any disclaimer, the term of this patent is extended or adjusted under 35 U.S.C. 154(b) by 291 days.

(21) Appl. No.: 10/826,992

(22) Filed: Apr. 19, 2004

(65) Prior Publication Data

US 2004/0209750 A1 Oct. 21, 2004

Related U.S. Application Data

(60) Provisional application No. 60/463,824, filed on Apr. 18, 2003.

(51) Int. Cl.
*A63B 21/02* (2006.01)

(52) U.S. Cl. ..... 482/123; 482/129; 482/130; 482/140; 482/95

(58) Field of Classification Search ..... 482/129, 482/130, 123, 140, 133, 135, 72, 95–6, 142; 5/618, 620, 630, 632–4
See application file for complete search history.

(56) References Cited

U.S. PATENT DOCUMENTS 4,300,760 A * 11/1981 Bobroff ..... 482/96
5,069,447 A * 12/1991 Snyderman et al. ..... 482/133
5,346,447 A 9/1994 Stearns
5,533,953 A * 7/1996 Lui et al. ..... 482/96
5,626,542 A * 5/1997 Dalebout et al. ..... 482/96
5,658,225 A * 8/1997 Huang ..... 482/72
5,665,041 A 9/1997 Hsieh
5,702,334 A 12/1997 Lee
5,769,766 A 6/1998 Huang
5,827,158 A * 10/1998 Drecksel ..... 482/96
5,833,590 A * 11/1998 Chiu et al. ..... 482/142
5,839,998 A 11/1998 Wilkinson
5,951,448 A * 9/1999 Bolland ..... 482/112
5,997,450 A 12/1999 Wilkinson
6,206,809 B1 * 3/2001 Habing et al. ..... 482/96
6,244,995 B1 6/2001 Prsala
6,390,960 B1 5/2002 Boland
6,425,845 B1 7/2002 Varner
6,793,610 B1 * 9/2004 Deola ..... 482/130
2003/0060342 A1 * 3/2003 Chen ..... 482/92
2003/0176263 A1 9/2003 Parmater

* cited by examiner

*Primary Examiner*—Stephen R. Crow
*Assistant Examiner*—Allana Lewin
(74) *Attorney, Agent, or Firm*—Brouse McDowell; Heather M. Barnes

(57) ABSTRACT

An exercise apparatus includes a pressing bar assembly interconnected to a lifting assembly. As the pressing bar assembly is pivoted, the lifting assembly also pivots and angularly raises a seat assembly on which a user is positioned. Resistance bands and the user's own weight provide resistance to movement of the pressing bar assembly. A user may perform a variety of exercises on the inventive apparatus according to the position of the body. A user may perform exercises from an initial sitting position, an initial side-lying position, an initial prone position, or an initial kneeling position.

21 Claims, 8 Drawing Sheets

EXERCISE APPARATUS AND METHOD

This application claims priority from a provisional patent application having Ser. No. 60/463,824, which was filed on Apr. 18, 2003 and is incorporated herein by reference.

I. BACKGROUND OF THE INVENTION

The present invention relates to an exercise apparatus, and more particularly to an exercise apparatus designed to promote flexibility, toning, firming and strength of the user's legs, thighs, buttocks, upper body, and abdominal muscles.

People have shown increased interest in physical fitness and muscular body toning in recent years. Various exercise apparatuses have been designed to meet consumer demand for fitness equipment.

For example, U.S. Pat. No. 6,206,809 to Habing et al. discloses an exercise apparatus including a rigid frame having upper and lower back supports pivotally connected in axial alignment. Leverage arms, mounted at the head end of the upper back support, extend above the frame so that a user may grasp them while performing abdominal exercises. The lower back support includes handles that a user may grasp while performing gluteus exercises. A thigh pad is pivotally attached to the lower back support. When the user applies a lifting force against the thigh pad, the lower back support is raised along with the body of the user. Abdominal curls or crunching exercises are performed by grasping the leverage arms and pulling up the upper back support.

Additionally, U.S. Pat. No. 5,665,041 to Hsieh discloses an abdominal exerciser including a base member and a seat pad fixed to the base member. The exerciser includes a foot support assembly pivotally mounted to the base member about a first horizontal axis and a back support assembly pivotally mounted to the base member about a second horizontal axis. The foot support assembly and the back support assembly are interconnected for concurrent pivoting movement in opposite angular directions.

The exercise apparatuses discussed above do not provide the action of the present invention as a user utilizes the apparatus disclosed herein.

II. SUMMARY OF THE INVENTION

The present invention is directed toward a novel exercise apparatus. An exercise apparatus comprises horizontal support means; a leg bar assembly pivotally mounted to the horizontal support means and being generally moveable between a substantially vertical position and a first range of angular positions; a lift bar assembly pivotally mounted to the horizontal support means and selectively engageable with the leg bar assembly through linkage means and being generally moveable between a substantially horizontal position and a second range of angular positions; a seat assembly pivotally mounted to the horizontal support means being generally moveable between a substantially horizontal position and a third range of angular positions, the seat assembly including a seat member having a lower surface that is selectively engageable with the lift bar assembly; and, a resistance band extending between the horizontal support means and the lift bar assembly.

It is yet another object of the present invention to provide an exercise apparatus further comprising a head rest assembly being pivotally mounted relative to the seat assembly.

Another object of the present invention is to provide an exercise apparatus, wherein the head rest assembly further comprises a head rest assembly comprising a head support frame, a pair of hand grips extending from the head support frame and a head rest cushion.

Still yet, another object of the present invention is to provide an exercise apparatus, wherein the apparatus is portable.

Yet, another object of the present invention is to provide an exercise apparatus, wherein the apparatus is adapted to fold for storage.

Another object of the present invention is to provide an exercise apparatus, wherein the horizontal support means is a bottom frame assembly having first and second ends and being adapted for support on a substantially horizontal surface, the bottom frame assembly comprising a cross member and first and second side members defining a first plane, wherein the cross member is located near the second end of the bottom frame assembly.

Still, another object of the present invention is to provide an exercise apparatus, wherein the lift bar assembly comprises first and second spaced arm members, a cross member extending between the first and second arm members, and a wheel member, the lift bar assembly adapted for selective engagement with the leg bar assembly through linkage means.

Further yet, another object of the present invention is to provide an exercise apparatus, further comprising interconnecting means pivotally connected to the seat assembly support tube at a first end thereof and pivotally connected to the head support assembly at a second end thereof.

Another object of the present invention is to provide an exercise apparatus, wherein the resistance band is selectively removable.

Another object of the present invention is to provide an exercise apparatus for targeting leg, buttock and abdominal muscles, comprising a bottom frame assembly having first and second ends and being adapted for support on a substantially horizontal surface; a leg bar assembly pivotally mounted to the horizontal support means and being generally moveable between a substantially vertical position and a first range of angular positions; a lift bar assembly pivotally mounted to the bottom frame assembly and selectively engageable with the leg bar assembly through a link and being generally moveable between a substantially horizontal position and a second range of angular positions; a seat assembly pivotally mounted to the bottom frame assembly being generally moveable between a substantially horizontal position and a third range of angular positions, the seat assembly including a seat member having a lower surface that is selectively engageable with the lift bar assembly; and, a selectively removable resistance band extending between the bottom frame assembly and the lift bar assembly.

Still, another object of the present invention is to provide an exercise apparatus, further comprising a securing plate, wherein first mount means operatively connects the leg bar assembly to the securing plate and second mounting means operatively connects the lift bar assembly to the securing plate to achieve pivotal movement of the leg bar assembly and the lift bar assembly.

Further, another object of the present invention is to provide an exercise apparatus, wherein the seat assembly is selectively engagable with a wheel member of the lift bar assembly.

It is still another object of the present invention to provide an exercise apparatus, wherein the lower surface of the seat member further comprises a plate for engagement with the wheel member.

Yet, another object of the present invention is to provide a method for using an exercise device, comprising the steps of:

providing horizontal support means;

providing a leg bar assembly pivotally mounted to the horizontal support means and being generally moveable between a substantially vertical position and a first range of angular positions;

providing a lift bar assembly pivotally mounted to the horizontal support means and selectively engageable with the leg bar assembly through linkage means and being generally moveable between a substantially horizontal position and a second range of angular positions;

providing a seat assembly pivotally mounted to the horizontal support means being generally moveable between a substantially horizontal position and a third range of angular positions, the seat assembly including a seat member having a lower surface that is selectively engageable with the lift bar assembly; and, providing a resistance band extending between the horizontal support means and the lift bar assembly;

engaging the lift bar assembly and the leg bar assembly to target specific muscles.

Still yet, another object of the present invention is to provide a method for using an exercise device, wherein the muscles are leg muscles.

Yet, another object of the present invention is to provide a method for using an exercise device, wherein the muscles are abdominal muscles.

Another object of the present invention is to provide a method for using an exercise device, wherein the muscles are buttock muscles.

It is yet another object of the present invention to provide an exercise apparatus that is economical and easy to use.

Still other benefits and advantages of the invention will become apparent to those skilled in the art to which it pertains upon a reading and understanding of the following detailed specification.

III. BRIEF DESCRIPTION OF THE DRAWINGS

IV. DETAILED DESCRIPTION OF A PREFERRED EMBODIMENT

Figure 1:
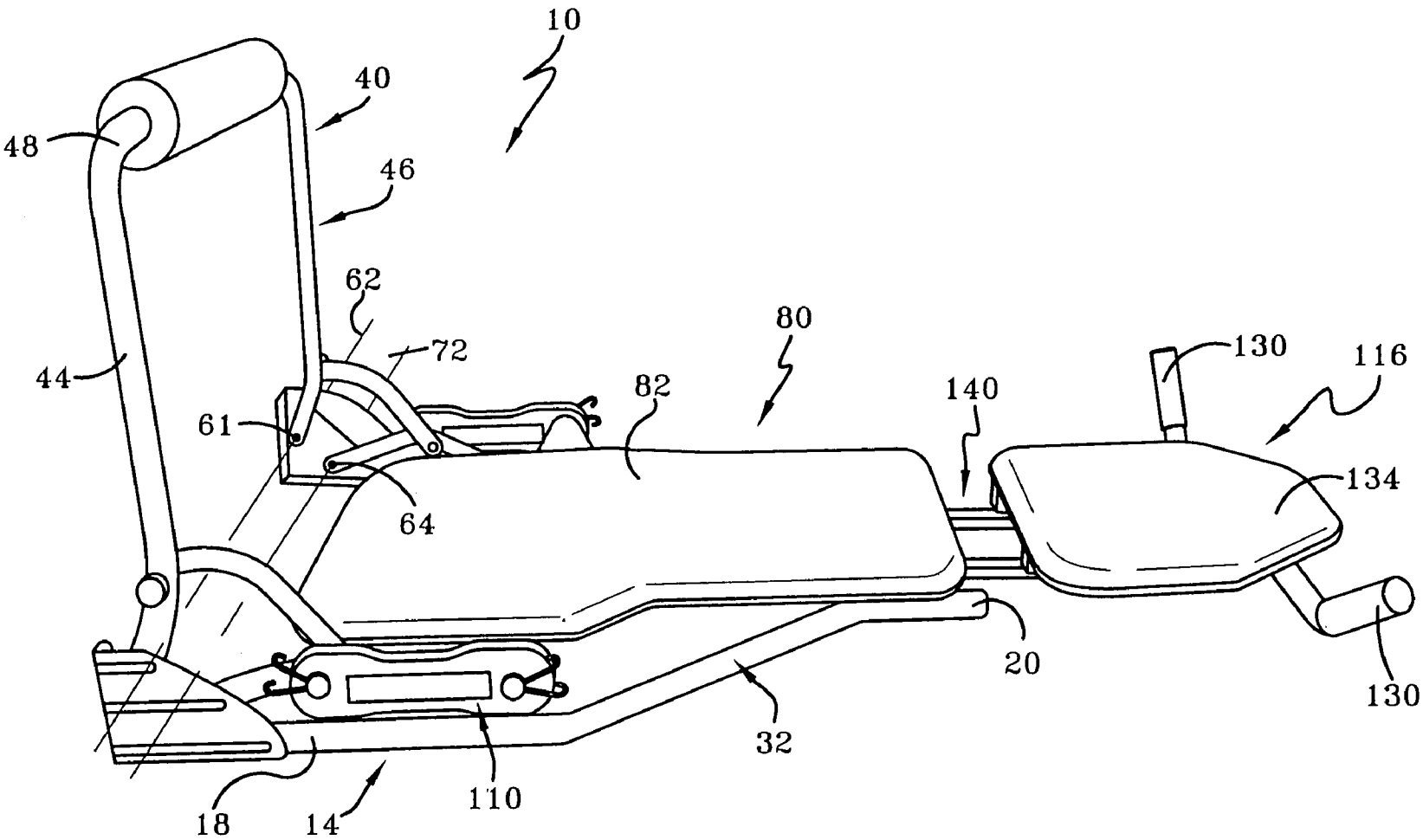
FIG. 1 is a perspective view of one embodiment of the exercise apparatus according to the present invention.

Referring now to the drawings wherein the showings are for purposes of illustrating a preferred embodiment of the invention only and not for purposes of limiting the same, FIG. 1–11 show the present invention. In this description of the preferred embodiment, the terms "horizontal" and "vertical" refer to positions when the claimed exercise apparatus is deployed and ready for use.

Figure 2:
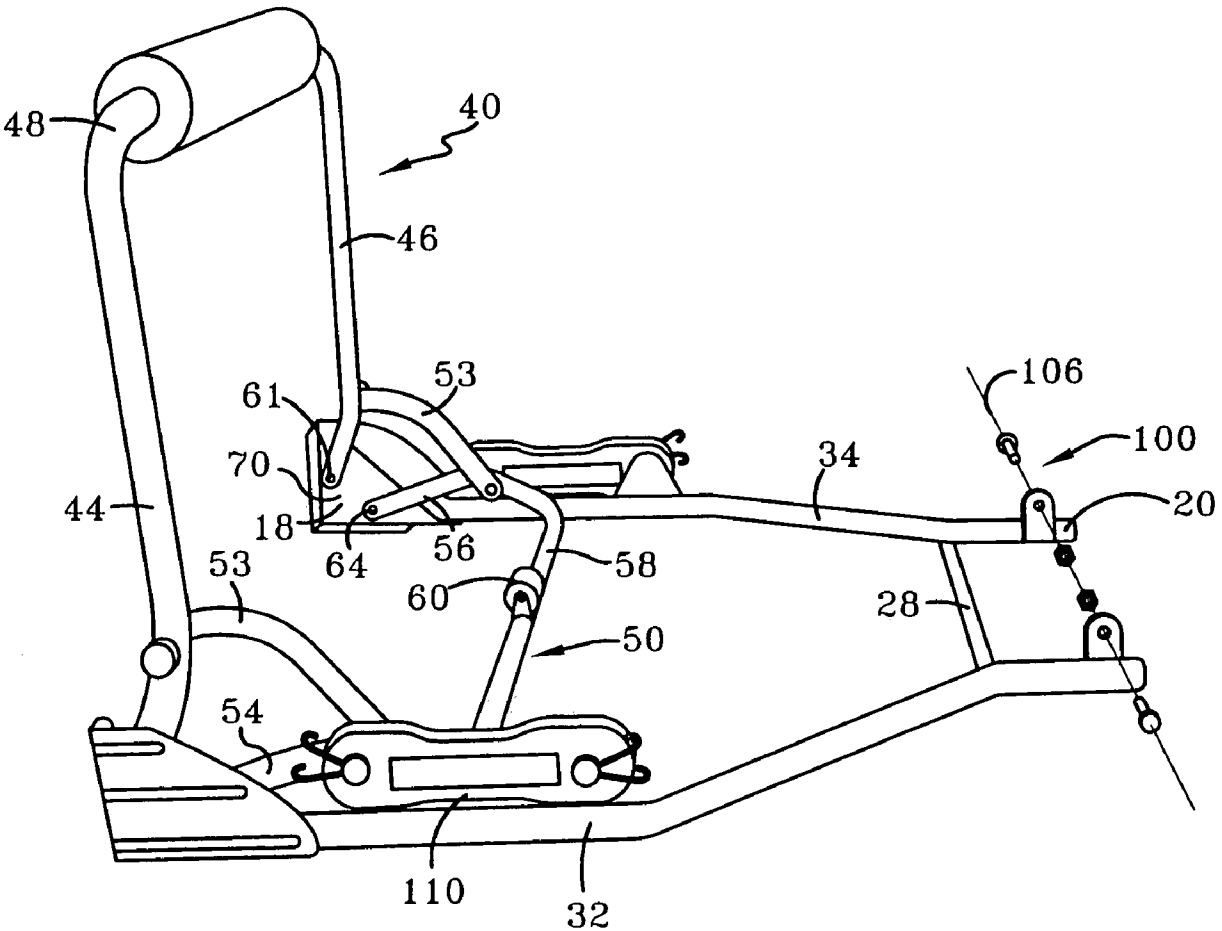
FIG. 2 is a perspective view showing the interconnection of the bottom frame assembly, the leg bar assembly and the lift bar assembly in operative relationship to one another.

With reference to FIGS. 1 and 2, the exercise apparatus 10 includes a bottom frame assembly 14 having first and second ends 18, 20 and being adapted for support on a substantially horizontal surface. The bottom frame assembly 14 includes a cross member 28 and first and second side members 32, 34 defining a first plane, wherein the cross member 28 is located near the second end 20 of the bottom frame assembly 14.

In the preferred embodiment, the exercise apparatus 10 includes a leg bar assembly 40 that has first and second spaced arms 44, 46 and a crosspiece 48. A foam roll 49 encircles the crosspiece 48 to provide comfort to the user.

The exercise apparatus 10 further includes a lift bar assembly 50 comprising first and second spaced arm members 54, 56, a cross member 58 extending between the first and second arm members, and a wheel member 60 operatively connected to the cross member 58.

The lift bar assembly 50 is adapted for selective engagement with the leg bar assembly 40 through first and second arm members 54, 56 and linkage 53.

Also, the preferred embodiment includes first mounting means 61 disposed at the first end 18 of the bottom frame assembly 14. The first mounting means 61 may be a nut and bolt secured to a securing plate 70. Although, any means chosen with sound engineering judgment may be utilized to secure the bottom frame assembly 14. First mounting means 61 operates to mount the leg bar assembly 40 relative to the bottom frame assembly 14 so that said leg bar assembly 40 is pivotally moveable about a first horizontal axis 62 between a substantially vertical position and a first range of angular positions $\alpha 1$.

The preferred embodiment includes second mounting means 64 for mounting the lift bar assembly 50 relative to the bottom frame assembly 14 so that the lift bar assembly 50 is pivotally moveable about a second horizontal axis 72 between a substantially horizontal position and a second range of angular positions $\alpha 2$. Second mounting means 64 may be a nut and bolt secured to the securing plate 70, or other arrangement chosen with sound engineering judgment.

Figure 3:
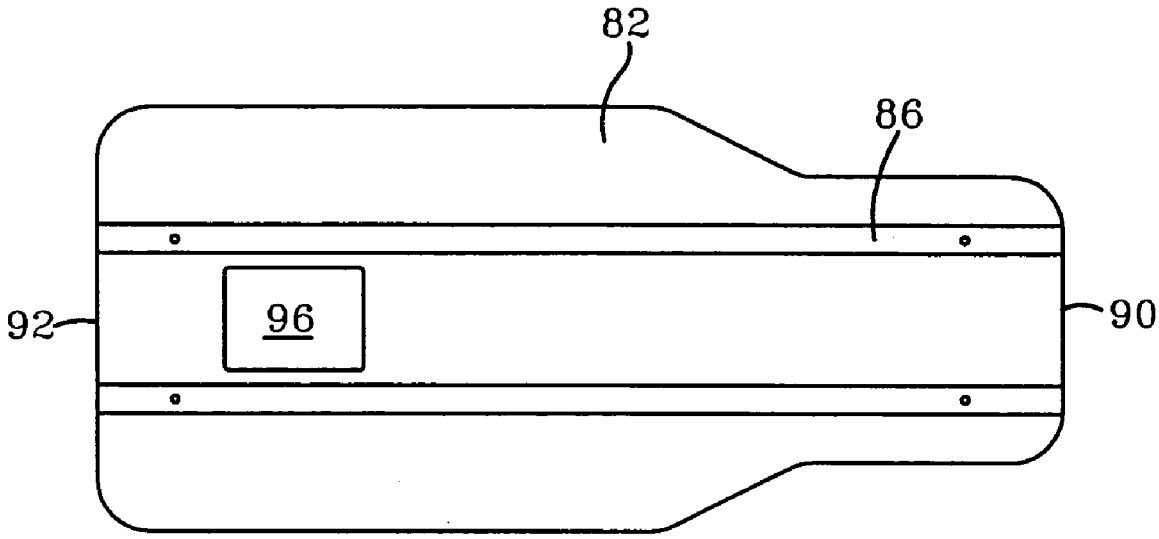
FIG. 3 is a bottom view of a seat assembly according to the invention.

With reference to FIGS. 1 and 3, a seat assembly 80 is disposed generally above the bottom frame assembly 14. The seat assembly 80 includes a seat member 82 fixedly secured to a support member 86, which may take the form of a tube. The seat assembly 80 has a top end 90 and a bottom end 92. The seat member 82 includes a lower surface 96 for selective engagement with the wheel member 60 of the lift bar assembly 50. In a preferred embodiment, lower surface 96 includes a metal plate for reinforcement of the seat member 82 and for ease of engagement with the wheel member 60.

Figure 6A:
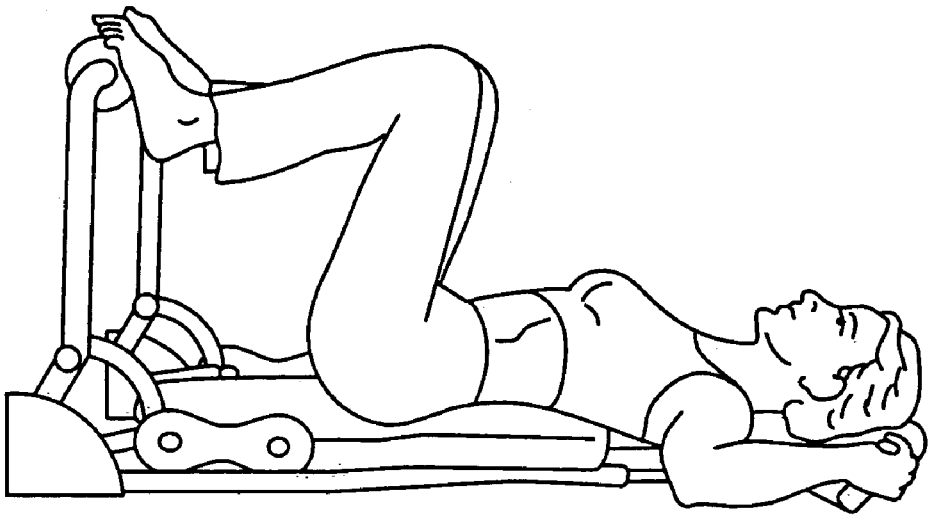
FIGS. 6A–6B illustrate use of the inventive exercise apparatus showing simultaneous movement of the leg bar assembly, the lift bar assembly and the seat assembly.
Figure 6B:
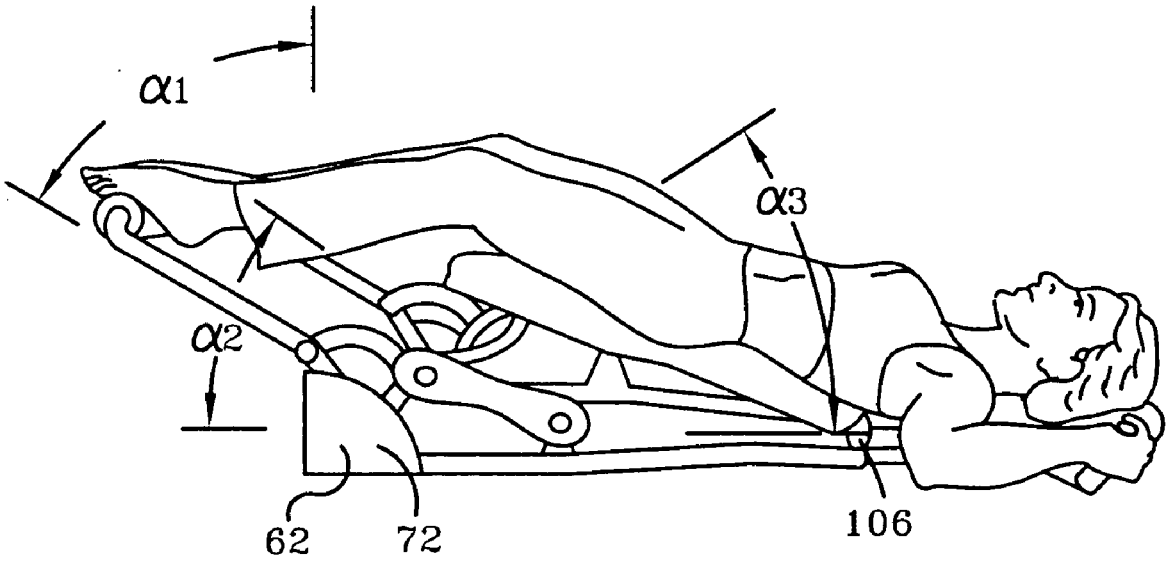

The preferred embodiment also includes third mounting means 100 disposed at the second end 20 of the bottom frame assembly 14. The third mounting means 100 is operable to mount the seat assembly 80 relative to the bottom frame assembly 14 so that the seat member 82 is pivotally moveable about a third horizontal axis 106 between a substantially horizontal position and a third range of angular positions $\alpha 3$, as shown in FIG. 6B. The third mounting means 100 may be any arrangement chosen in accordance with sound engineering judgment, including, but not limited to, a bolt and nut.

With continuing reference to FIGS. 1 and 2, the exercise device 10 may comprise at least one resistance band 110 extending between the bottom frame assembly 14 and the lift bar assembly 50. In the preferred embodiment, there are two such resistance bands interconnecting the bottom frame assembly 14 and the lift bar assembly 50. In use, a user pushes against the leg bar assembly 40 which is interconnected to the lift bar assembly 50. The resistance band(s) 110 resist the pivotal movement of the lift bar assembly 50 to accomplish the exercise goals. The resistance band 110 may be selectively removable from the bottom frame assembly 14 and the lift bar assembly 50. The resistance band 110 may utilize spring clips, or any other mechanism, to secure it to the exercise device 10.

Figure 5A:
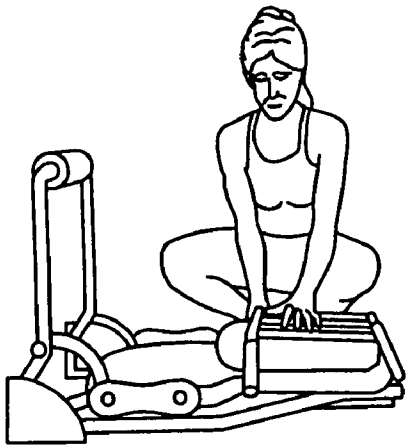
FIGS. 5A–5E show a user partially disengaging the exercise apparatus for convenient storage and handling.
Figure 5B:
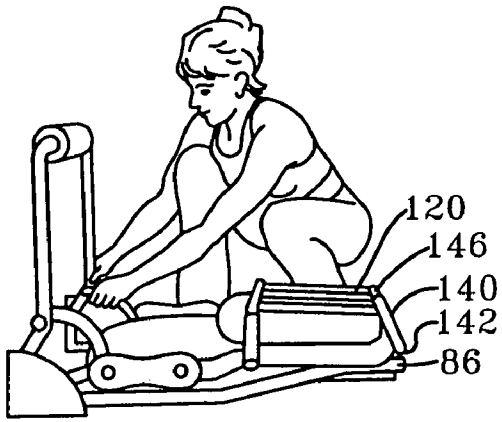
Figure 5C:
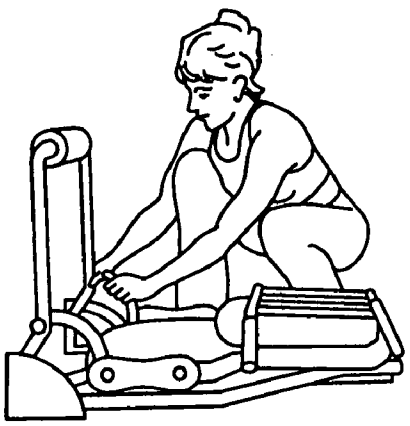
Figure 5D:
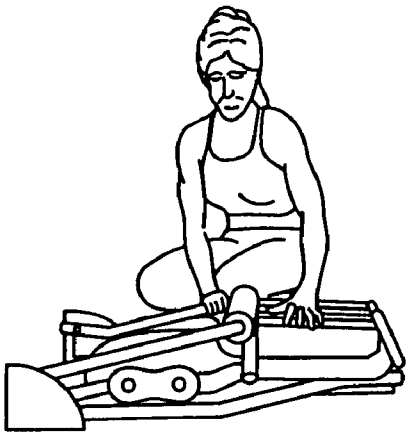
Figure 5E:
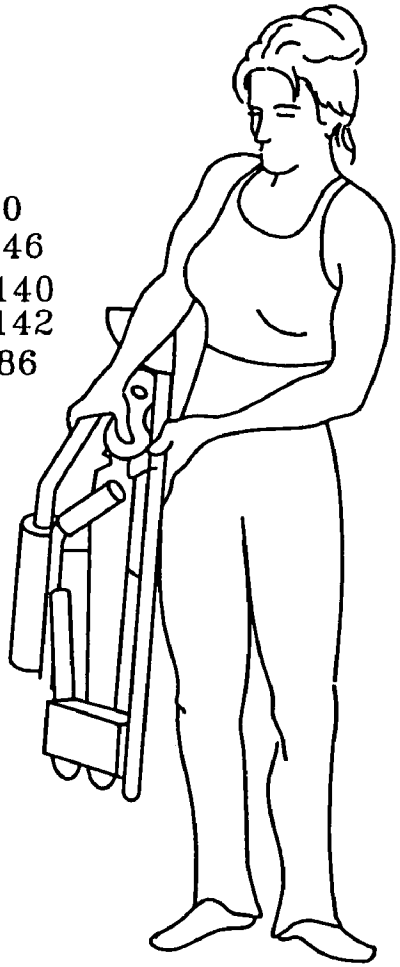

With reference to FIGS. 1 and 5B, the exercise apparatus 10 may further include a head rest assemb1y 116 comprising a head support frame 120, a pair of hand grips 130 extending from said head support frame 120 and a head rest cushion 134. There is also provided interconnecting means 140 pivotally connected to the seat assembly support tube 86 at a first end 142 thereof and pivotally connected to the head support frame 120 at a second end 146 thereof.

Figure 4A:
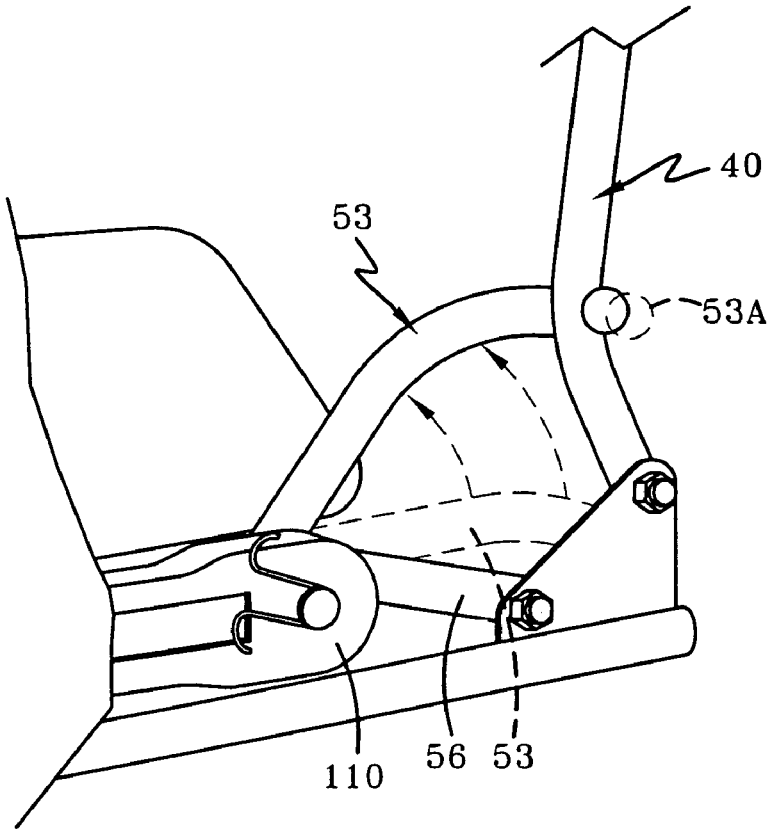
FIG. 4A is a perspective view showing the selective interconnection of a link bar with the leg bar assembly.
Figure 4B:
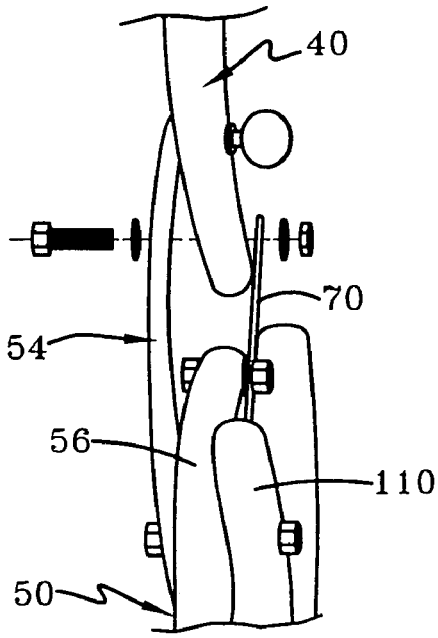
FIG. 4B is a front view showing the selective interconnection of a link bar with the leg bar assembly.

FIGS. 4A and 4B illustrate one embodiment of interconnecting the leg bar assembly 40 with the lift bar assembly 50. A pop pin 53A may be utilized to move linkage 53 for storing the exercise device 10. More specifically, pulling the pop pin 53A releases engagement with the leg bar assembly 40.

FIGS. 5A–5E illustrate the steps taken when a user desires to fold the exercise apparatus for storage or transporting. The head rest assembly 116 folds toward the seat member 82. The linkage means 54 may be selectively disengaged to permit the leg bar assembly 40 to be folded toward the seat member 82.

Figure 7A:
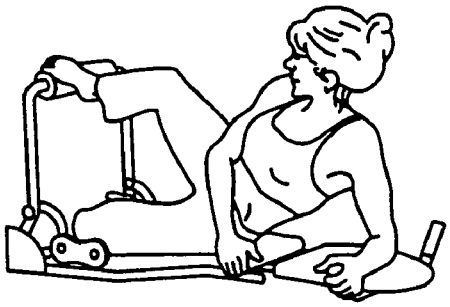
FIGS. 7A–7B illustrate a user utilizing the inventive exercise apparatus to perform an outer thigh side leg press.
Figure 7B:
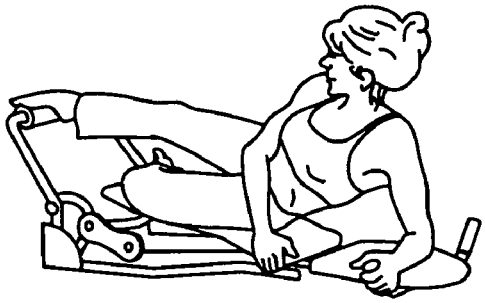

With reference to FIGS. 7A and 7B, a user's body is positioned for example so the left side of the body is carried on the seat member 82. The user's right foot is placed onto the leg bar assembly 40. The user applies force against the leg bar assembly 40 with the right foot. The movement is resisted by the resistance band 110 and the user's own weight. By changing the angle of the foot on the leg bar assembly 40, a user may change the focus of the muscle group or gorups being strengthened.

Figure 8A:
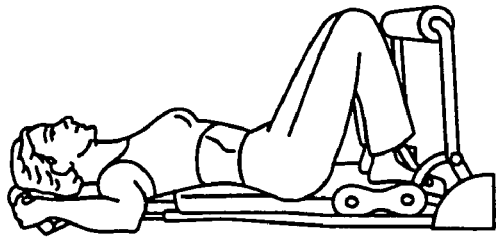
FIGS. 8A–8B illustrate a user utilizing the inventive exercise apparatus to perform an abdominal assist or crunch exercise.
Figure 8B:
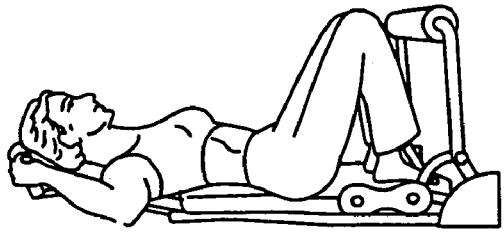

With reference to FIGS. 8A and 8B, a user lies down on the seat member 82 with both knees bent and feet flat. The user's head is positioned on the headrest 134. The user positions the hands on the handgrips 130. The user pulls up the handgrips 130 and rocks slightly forward to perform an assisted crunch.

Figure 9A:
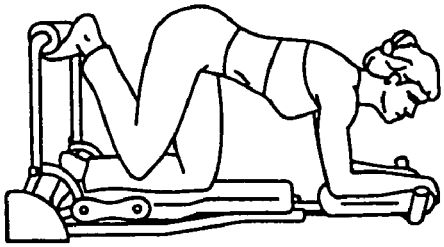
FIGS. 9A–9B illustrate a user utilizing the inventive exercise apparatus to perform a kick back exercise.
Figure 9B:
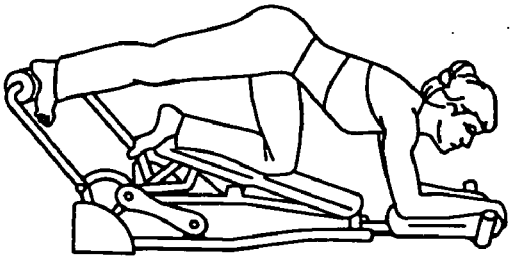

With reference to FIGS. 9A and 9B, the user's body is positioned on all fours with legs closest to the leg bar assembly 40. One leg, for example the right leg, is lifted backward and the heel is positioned on the crosspiece 48. The crosspiece 48 is pushed outward and returned to its initial position to perform a kick back exercise. If the user's body is moved closer toward the leg bar assembly 40, more body weight will be lifted with each kick.

Figure 10A:
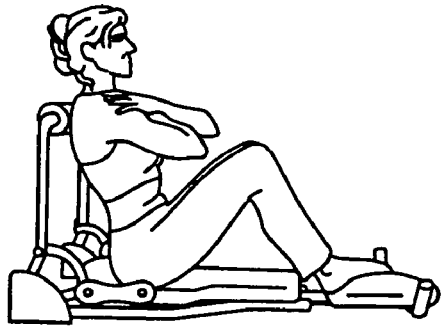
FIGS. 10A–10B illustrate a user utilizing the inventive exercise apparatus to perform a back extension exercise.
Figure 10B:
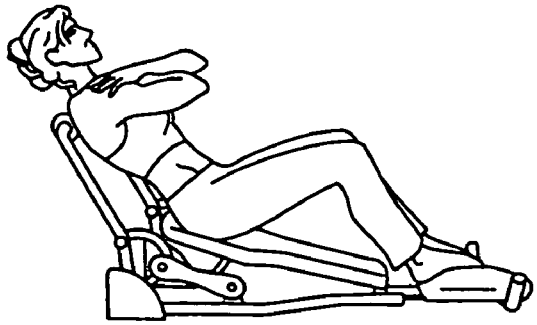

With reference to FIGS. 10A and 10B, a user sits on the seat member 82 with the back positioned against the leg bar assembly 40 approximately 2 inches down from the top of the shoulders. The arms are crossed across the chest with opposite hands resting on opposite shoulders. Force is applied to the crosspiece 48 and the back is extended. The user returns to the upright sitting position to complete the exercise. Further, when the user returns to the upright sitting position the abdominal muscles are worked due to negative resistance of the apparatus.

Many other exercises may be performed by repositioning the user on the exercise apparatus. As the leg bar assembly 40 is pivoted relative to the bottom frame assembly 14, the lift bar assembly 50 also pivots from an initial horizontal position. The cross member 58 is lifted and the wheel member 60 rides against the lower surface 96 of the seat member 82. The resistance band(s) and the user's weight oppose the motion of the leg bar when the desired exercises are performed.

Figure 11:
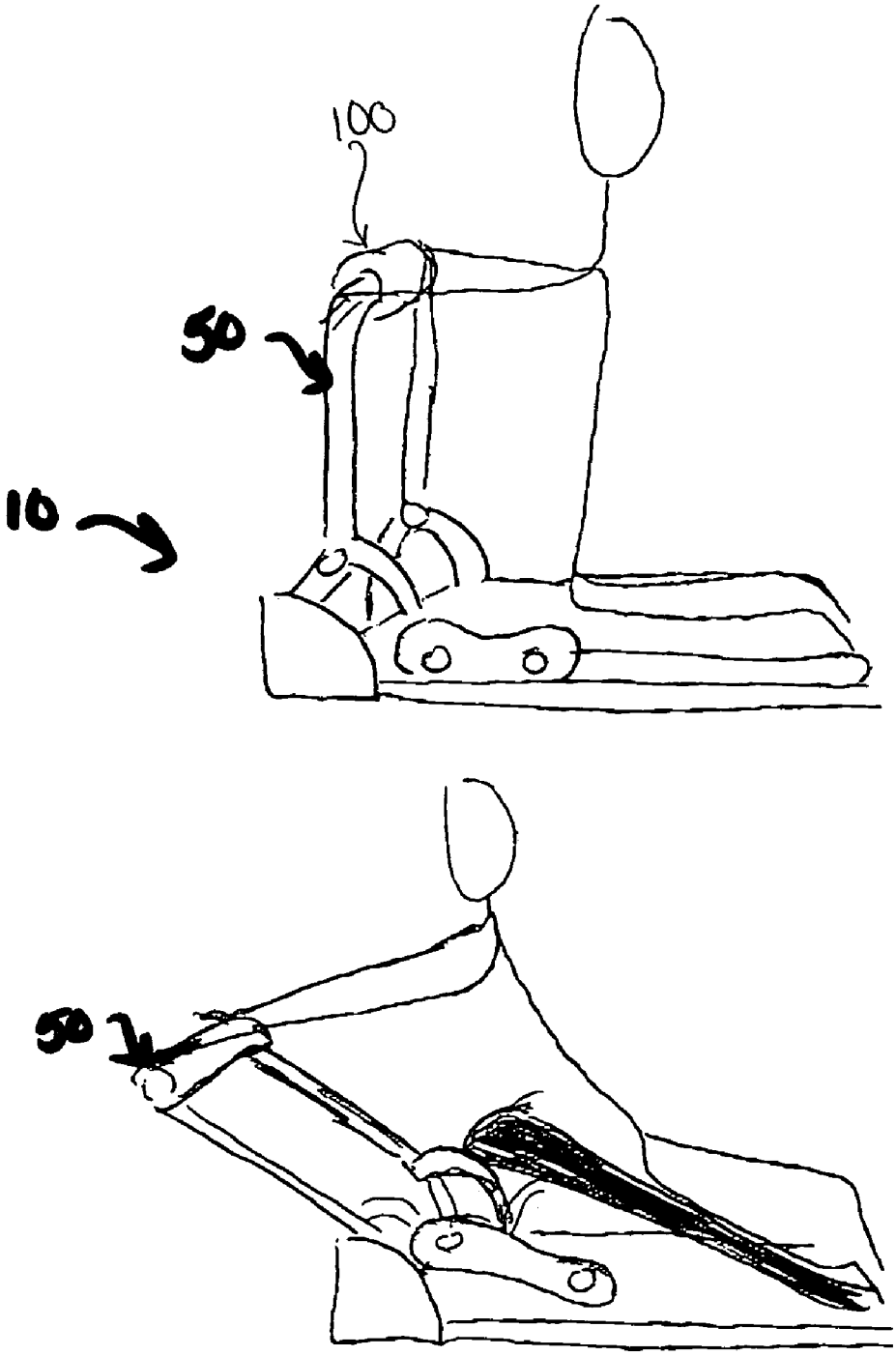
FIG. 11 illustrates a user utilizing the inventive exercise apparatus to perform an exercise for the upper body.

With reference to FIG. 11, another exercise is shown which focuses on the upper body. In a kneeling position, facing the lift bar assembly 50, a user grips the lift bar assembly with hands at outer corners of the lift bar assembly. Hand position 100 focuses on pectoralis and upper back muscles including triceps. The user presses the lift bar assembly 50 out using the upper body to activate this motion. The user returns the lift bar assembly 50 to the start position, allowing the lift bar assembly 50 to come back into the chest. For a more intense focus on the triceps, a user may change his or her hand grip to a center grip on the lift bar assembly 50 and repeat the same movements.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which would be within the full-intended scope of the invention as defined by the following appended claims.

What is claimed is:

1. An exercise apparatus, comprising:

hoizontal support means;

a leg bar assembly pivotaily mounted to said horizontal support means and being generally moveable between a substantially vertical position and a first range of angular positions;

a lift bar assembly pivotally mounted to said horizontal support means and selectively engageable with said leg bar assembly through linkage means and being generally moveable between a substantially horizontal position and a second range of angular positions;

a seat assembly pivotally mounted to said horizontal support means being generally moveable between a substantially horizontal position and a third range of angular positions, said seat assembly including a seat member having a lower surface that is selectively engageable with a wheel member of said lift bar assembly; and, a resistance band extending between said horizontal support means and said lift bar assembly.

2. The exercise apparatus of claim 1, further comprising a head rest assembly being pivotally mounted relative to said seat assembly.

3. The exercise apparatus of claim 2, wherein said head rest assembly further comprises a head support frame, a pair of hand grips extending from said head support frame and a head rest cushion.

4. The exercise apparatus of claim 1, wherein said apparatus is portable.

5. The exercise apparatus of claim 1, wherein said apparatus is adapted to fold for storage.

6. The exercise apparatus of claim 1, wherein said horizontal support means is a bottom frame assembly having first and second ends and being adapted for support on a substantially horizontal surface, said bottom frame assembly comprising a cross member and first and second side members defining a first plane, wherein said cross member is located near said second end of said bottom frame assembly.

7. The exercise apparatus of claim 1, wherein said lift bar assembly comprises first and second spaced arm members, a cross member extending between said first and second arm members, and a wheel member, said lift bar assembly adapted for selective engagement with said leg bar assembly through linkage means.

8. The exercise apparatus of claim 2, further comprising interconnecting means pivotally connected to a seat assembly support tube at a first end thereof and pivotally connected to said head support assembly at a second end thereof.

9. The exercise apparatus of claim 1, wherein said resistance band is selectively removable.

10. An exercise apparatus for targeting leg, buttock and abdominal muscles, comprising:

a bottom frame assembly having first and second ends and being adapted for support on a substantially horizontal surface;

a leg bar assembly pivotally mounted to said horizontal support means and being generally moveable between a substantially vertical position and a first range of angular positions;

a lift bar assembly pivotally mounted to said bottom frame assembly and selectively engageable with said leg bar assembly through a link and being generally moveable between a substantially horizontal position and a second range of angular positions;

a seat assembly pivotally mounted to said bottom frame assembly being generally moveable between a substantially horizontal position and a third range of angular positions, said seat assembly including a seat member having a lower surface that is selectively engageable with said lift bar assembly;

a selectively removable resistance band extending between said bottom frame assembly and said lift bar assembly; and a securing plate, wherein a first mount means operatively connects said leg bar assembly to said securing plate and a second mounting means operatively connects said lift bar assembly to said securing plate to achieve pivotal movement of said leg bar assembly and said lift bar assembly.

11. The exercise apparatus of claim 10, wherein said seat assembly is selectively engagable with a wheel member of said lift bar assembly.

12. The exercise apparatus of claim 11, wherein said lower surface of said seat member further comprises a plate for engagement with said wheel member.

13. The exercise apparatus of claim 10, wherein said exercise device is portable.

14. A method for using an exercise device, comprising the steps of:

providing horizontal support means;

providing a leg bar assembly pivotally mounted to said horizontal support means and being generally moveable between a substantially vertical position and a first range of angular positions;

providing a lift bar assembly pivotally mounted to said horizontal support means and selectively engageable with said leg bar assembly through linkage means and being generally moveable between a substantially horizontal position and a second range of angular positions;

providing a seat assembly pivotally mounted to said horizontal support means being generally moveable between a substantially horizontal position and a third range of angular positions, said seat assembly including a seat member having a lower surface that is selectively engageable with said lift bar assembly;

providing a resistance band extending between said horizontal support means and said lift bar assembly;

providing a securing plate, wherein a first mount means operatively connects said leg bar assembly to said securing plate and a second mounting means operatively connects said lift bar assembly to said securing plate to achieve pivotal movement of said leg bar assembly and said lift bar assembly; and engaging said lift bar assembly and said leg bar assembly to target specific muscles.

15. The method of claim 14, wherein said muscles are leg muscles.

16. The method of claim 14, wherein said muscles are abdominal muscles.

17. The method of claim 14, wherein said muscles are buttock muscles.

18. The method of claim 14, wherein said muscles are upper body muscles.

19. The method of claim 14, further comprising the step of removing said resistance band.

20. An exercise apparatus, comprising:

a bottom frame assembly having first and second ends and being adapted for support on a substantially horizontal surface, said bottom frame assembly comprising a cross member and first and second side members defining a first plane, wherein said cross member is located near said second end of said bottom frame assembly;

a leg bar assembly including first and second spaced arms and a cross piece;

a lift bar assembly comprising first and second spaced arm members, a cross member extending between said first and second arm members, and a wheel member, said lift bar assembly adapted for selective engagement with said leg bar assembly through linkage means;

first mounting means disposed at said first end of said bottom frame assembly for mounting said leg bar assembly relative to said bottom frame assembly so that said leg bar assembly is pivotally moveable about a first horizontal axis between a substantially vertical position and a first range of angular positions;

second mounting means for mounting said lift bar assembly relative to said bottom frame assembly so that said lift bar assembly is pivotally moveable about a second horizontal axis between a substantially horizontal position and a second range of angular positions;

a seat assembly generally disposed above said bottom frame assembly and comprising a seat member fixedly secured to a support tube, said seat assembly having a top end and a bottom end, said seat member having a lower surface for selective engagement with said wheel member;

third mounting means disposed at said second end of said bottom frame assembly for mounting said seat assembly relative to said bottom frame assembly so that said seat member is pivotally moveable about a third horizontal axis between a substantially horizontal position and a third range of angular positions;

a resistance band extending between said bottom frame assembly and said lift bar assembly;

a head rest assembly comprising a head support frame, a pair of hand grips extending from said head support frame and a head rest cushion; and interconnecting means pivotally connected to said seat assembly support tube at a first end thereof and pivotally connected to said head support frame at a second end thereof.

21. An exercise apparatus for targeting leg, buttock and abdominal muscles, comprising:

a bottom frame assembly having first and second ends and being adapted for support on a substantially horizontal surface;

a leg bar assembly pivotally mounted to said horizontal support means and being generally moveable between a substantially vertical position and a first range of angular positions;

a lift bar assembly pivotally mounted to said bottom frame assembly and selectively engageable with said leg bar assembly and being generally moveable between a substantially horizontal position and a second range of angular positions;

a seat assembly pivotally mounted to said bottom frame assembly being generally moveable between a substantially horizontal position and a third range of angular positions, said seat assembly including a seat member having a lower surface that is selectively engageable with said lift bar assembly;

a selectively removable resistance band adapted to resist pivotal movement of said lift bar assembly; and a securing plate, wherein a first mount means operatively connects said leg bar assembly to said securing plate to achieve pivotal movement of said leg bar assembly and said lift bar assembly.

* * * * *

UNITED STATES PATENT AND TRADEMARK OFFICE

CERTIFICATE OF CORRECTION

PATENT NO. : 7,137,934 B2
APPLICATION NO. : 10/826992
DATED : November 21, 2006
INVENTOR(S) : Kim M. Parmater It is certified that error appears in the above-identified patent and that said Letters Patent is hereby corrected as shown below:

On Title Page, Item (76) should read,
--Kim M. Parmater.--

Signed and Sealed this

Thirteenth Day of February, 2007

JON W. DUDAS
*Director of the United States Patent and Trademark Office*